US009364827B2

(12) United States Patent
Gehrig et al.

(10) Patent No.: US 9,364,827 B2
(45) Date of Patent: Jun. 14, 2016

(54) PISTON-OPERATED PIPETTE WITH INTERCHANGEABLE DISPLACEMENT UNIT

(71) Applicant: BRAND GMBH + CO KG, Wertheim (DE)

(72) Inventors: Steffen Gehrig, Walldürn (DE); Günter Hochholzer, Werbach (DE); Burkard Schaub, Eussenheim (DE)

(73) Assignee: BRAND GMBH + CO KG, Wertheim (DE)

( * ) Notice: Subject to any disclaimer, the term of this patent is extended or adjusted under 35 U.S.C. 154(b) by 315 days.

(21) Appl. No.: 14/083,899

(22) Filed: Nov. 19, 2013

(65) Prior Publication Data

US 2014/0137672 A1 May 22, 2014

(30) Foreign Application Priority Data

Nov. 19, 2012 (DE) ..... 20 2012 011 043 U

(51) Int. Cl.
*B01L 3/02* (2006.01)
*B01L 3/00* (2006.01)

(52) U.S. Cl.
CPC ..... *B01L 3/0217* (2013.01); *B01L 3/0275* (2013.01); *B01L 2200/028* (2013.01)

(58) Field of Classification Search
CPC ..... B01L 2200/027; B01L 2200/028; B01L 3/0217; B01L 3/0275; F16B 2001/0035; Y10T 403/59; Y10T 403/591; Y10T 403/593; Y10T 403/595; Y10T 403/599
USPC ..... 403/321, 322.1, 322.4, DIG. 1; 422/100, 422/501, 509, 518, 521, 544, 546; 73/863.32, 864, 866.5
See application file for complete search history.

(56) References Cited

U.S. PATENT DOCUMENTS 4,041,764 A * 8/1977 Sabloewski ..... B01L 3/0224 422/925
4,779,467 A 10/1988 Rainin et al.
(Continued)

FOREIGN PATENT DOCUMENTS

DE 198 26 065 A1 12/1999
DE 19826065 A1 * 12/1999 ..... B01L 3/0217
(Continued)

OTHER PUBLICATIONS

Machine English Translation for DE 29924175.*
(Continued)

*Primary Examiner* — Peter Macchiarolo
*Assistant Examiner* — Anthony W Megna Fuentes
(74) *Attorney, Agent, or Firm* — Roberts Mlotkowski Safran & Cole, P.C.; David S. Safran

(57) ABSTRACT

A piston-operated pipette with a drive unit with a piston drive and a displacement unit mounted on the drive unit, the displacement unit being dismountable from the drive unit, the drive unit having an actuating drive for the piston drive and a receiving section for the displacement unit. The displacement unit has a fastening section which fits the receiving section of the drive unit, there being a first detachable mechanical connection between the actuating drive and the piston drive and there being a second detachable mechanical connection between the receiving section of the drive unit and the fastening section of the displacement unit. The second detachable mechanical connection is made as a magnetic connection. A mechanical arrangement for breaking the magnetic connection is provided between the receiving section and the fastening section, the magnetic connection being releasable by actuating the arrangement for breaking the magnetic connection.

23 Claims, 9 Drawing Sheets

(56) References Cited

U.S. PATENT DOCUMENTS

| | | | | |
|---|---|---|---|---|
| 5,906,795 | A * | 5/1999 | Nakashima | B01L 3/0275 422/509 |
| 6,428,750 | B1 * | 8/2002 | Rainin | B01L 3/0224 222/154 |
| 7,513,857 | B2 * | 4/2009 | Gueller | G01N 35/0099 222/504 |
| 7,635,326 | B2 | 12/2009 | Gueller et al. | |
| 7,690,293 | B2 * | 4/2010 | Bensley | F04B 9/02 403/DIG. 1 |
| 7,947,234 | B2 | 5/2011 | O'Connell et al. | |
| 7,976,793 | B2 | 7/2011 | Solotareff et al. | |
| 8,011,257 | B2 | 9/2011 | Kneucker et al. | |
| 8,318,108 | B2 * | 11/2012 | Suovaniemi | B01L 3/0217 422/500 |
| 2009/0117009 | A1 * | 5/2009 | Cote | B01L 3/0227 422/400 |
| 2009/0120967 | A1 | 5/2009 | Bensley | |

FOREIGN PATENT DOCUMENTS

| | | | | |
|---|---|---|---|---|
| DE | 299 24 175 | U1 | 3/2002 | |
| DE | 29924175 | U1 * | 3/2002 | B01L 3/0234 |
| DE | 10 2005 023 203 | A1 | 11/2006 | |
| DE | 10 2007 042 115 | A1 | 3/2009 | |
| DE | 102005023203 | B4 * | 6/2009 | B01L 3/0279 |
| EP | 0181957 | * | 5/1982 | B01L 3/0224 |
| EP | 0 181 957 | A1 | 5/1986 | |

OTHER PUBLICATIONS

Machine English Translation for DE 102005023203.*
Machine English Translation for DE 19826065.*
Machine English Translation for DE 0181957.*

* cited by examiner

PISTON-OPERATED PIPETTE WITH INTERCHANGEABLE DISPLACEMENT UNIT

BACKGROUND OF THE INVENTION

1. Field of the Invention

The invention relates to a piston-operated pipette with a drive unit and a displacement unit which is mounted on the drive unit, displacement unit having a piston drive for at least one piston and being dismountable from the drive unit. In practice, these piston-operated pipettes are used for transfer of liquids using pipette tips.

2. Description of Related Art

The German Patent Application DE-A-198 26 065 discloses a piston-operated pipette which shows a displacement unit as an air-displacement or positive displacement version. The connection on the piston-operated pipette between the drive unit and the displacement unit takes place via coupling apparatus composed of a magnet and a ferromagnetic element as well as means which fit axially into one another. On the one hand, there is a detachable mechanical connection between the piston actuation and the piston rod in the center of the piston-operated pipette. On the other hand, there is a circular ring-shaped detachable mechanical connection between the housings of the drive unit and of the displacement unit. In addition, the displacement unit has an information medium with information about itself and its use. This information is transmitted on the coupling apparatus as galvanic interfaces.

In this case, the two detachable mechanical connections, both of which are made as magnetic connections, are released by manually pulling the drive unit and the displacement unit apart.

These piston-operated pipettes, as so-called multichannel pipettes, have eight or twelve piston-cylinder units, and accordingly, require high actuation forces. The same also occurs in single-channel, large volume pipettes. The detachable mechanical connections or coupling apparatus of the pipette transfer these forces so that their magnetic force must be high. In practice, it has been shown that the magnetic force can be overcome manually only with difficulty. Separation takes place suddenly, is unpleasant, and under certain circumstances can lead to injuries or damage. When the displacement unit is joined to the drive unit by the magnetic force, between the two components injuries can likewise occur.

Another piston-operated pipette is known from International Patent Application Publication WO 02/29419 A2, which corresponds to U.S. Pat. Nos. 7,513,857 and 7,635,326. This piston-operated pipette has a metering head which can be removed by means of a magnetic coupling apparatus. This device has a Cartesian system of axes for moving the metering head. One or more hollow needles into which liquid can be taken and dispensed are located on the metering head. The coupling apparatus is located between the metering head and a retaining device which is located on the system of axes. The metering head and the retaining device have a permanent magnet. To detach the coupling apparatus, the retaining device has an electromagnet which requires its own power supply. For a purely manual piston-operated pipette, this approach is ruled out. Fundamentally, one or more electromagnets are required which increases the weight of the piston-operated pipette considerably.

SUMMARY OF THE INVENTION

Thus, a primary object of the present invention is to configure and develop the known piston-operated pipette with a detachable mechanical connection which is made as a magnetic connection between the drive unit and the displacement unit such that it can be ergonomically operated and efficiently handled.

The aforementioned object is achieved in a piston-operated pipette as described herein.

The invention proceeds from the idea of overcoming or sufficiently weakening the magnetic force at least of the detachable mechanical connection which is made as a magnetic connection between the receiving section of the drive unit and the fastening section of the displacement unit with an additional mechanical means. The operator can thus easily and safely remove the displacement unit from the drive unit by himself or herself. The displacement unit can also be coupled again to the drive unit in the opposite direction using the mechanical means for breaking the magnetic connection in a gentle and controlled manner.

The magnetic connection of the piston-operated pipette in accordance with the invention is made to be more practical than in the prior art. The operator of the piston-operated pipette is safe in handling when separating the drive unit and the displacement unit from one another. This can take place without great manual application of force. The risk of injury by the sudden breaking of the magnetic connection is precluded. The joining of the drive unit and the displacement unit is also easily and safely possible.

The mechanical means for breaking the magnetic connection between the receiving section and the fastening section can be fundamentally actuated by a motorized actuator. An operator then actuate only one actuation element, for example, a pushbutton, and the actuator drives the mechanical means for breaking of the magnetic connection and breaks this magnetic connection.

However, it is especially preferred if the mechanical means for breaking the magnetic connection is a means which can be manually actuated, therefore which can be actuated by hand. This makes the structure of the piston-operated pipette simple and economical.

A construction is mechanically especially durable and advantageous in which the magnetic connection can be released simply by forcing the displacement unit away from the drive unit or vice versa. However, the magnetic connection can also be released only for itself by the components of the magnetic connection therefore being forced apart from one another, and in this way, the retaining force of the magnetic connection being weakened such that the displacement unit can then be easily removed from the drive unit.

The detachable mechanical connection between the actuating drive and the piston drive need not be made as a magnetic connection. In the prior art, the connection is made as a magnetic connection. However, the connection can also be made as a catch connection or the like. In the version as a magnetic connection, it is especially preferable that it can be released by an actuating means which can be manually actuated.

In a further preferred configuration, complete breaking is also avoided in a released magnetic connection by a retaining device so that the displacement unit does not simply fall from the drive unit.

The invention is explained in detailed below with reference to the accompanying drawings which show different exemplary embodiments in a nonlimiting manner. In the course of the explanation of the exemplary embodiments using the drawings, advantages and particulars of different versions of the invention are also explained.

BRIEF DESCRIPTION OF THE DRAWINGS

FIG. 2*a* shows the rest, starting and dispensing position, FIG. 2*b* shows a maximum aspiration position, FIG. 2*c* shows an over-travel position, FIG. 2*d* shows a separation position, FIG. 2*e* shows the separation process and FIG. 2*f* shows a mounting and dismounting position.

DETAILED DESCRIPTION OF THE INVENTION

Figure 1:
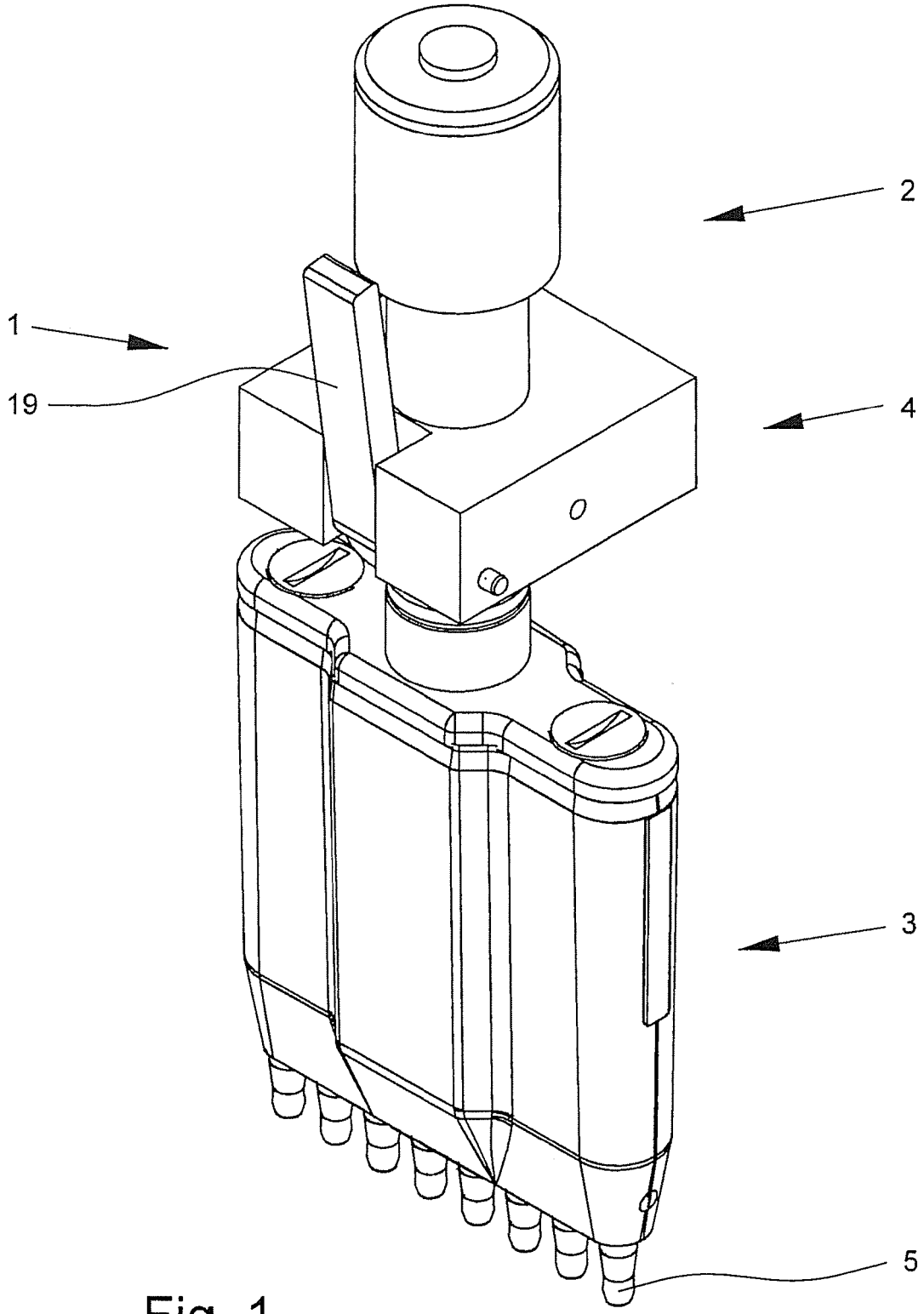
FIG. 1 is a perspective view of a piston-operated pipette in accordance with the invention.
Figure 3:
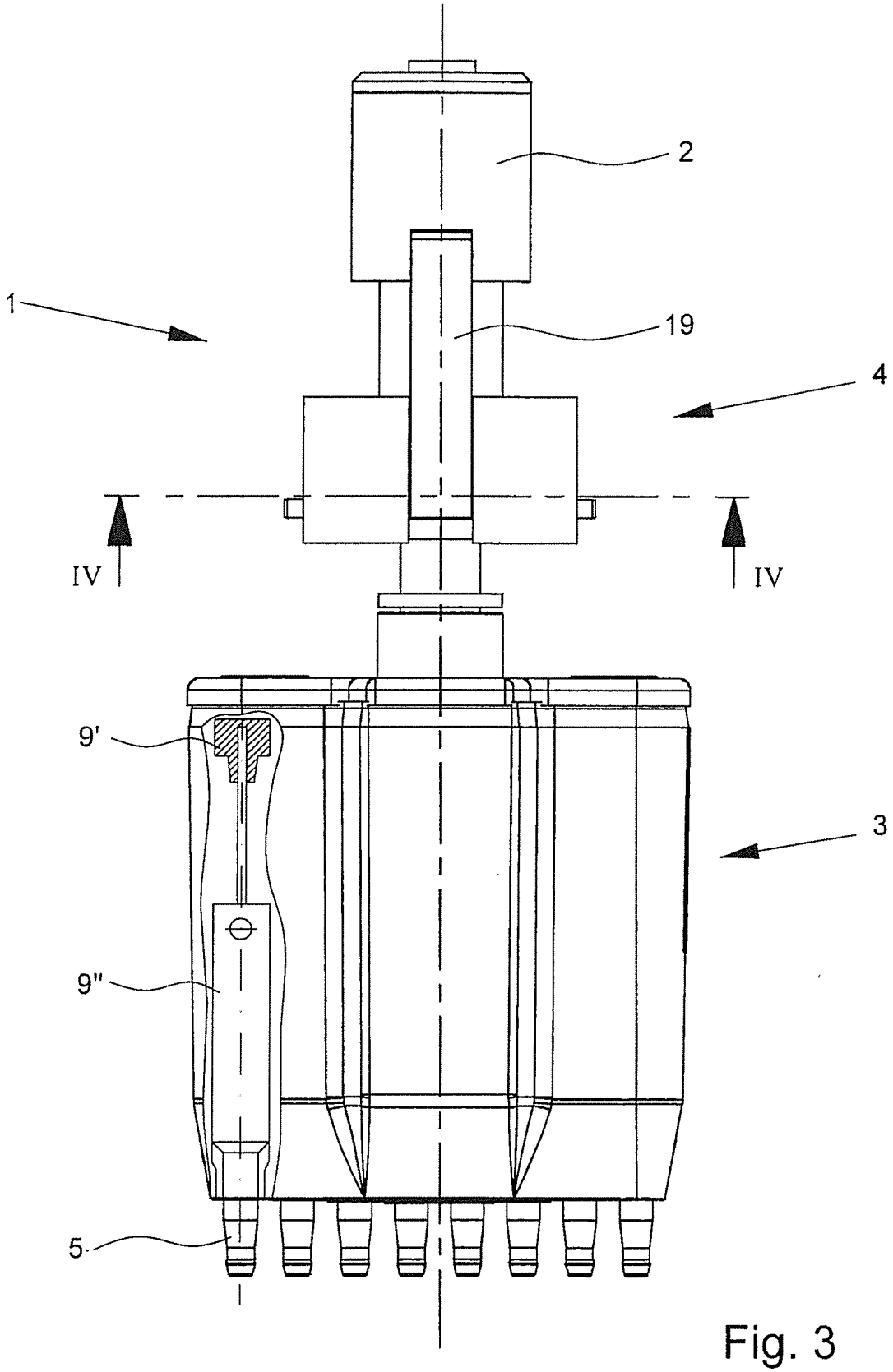
FIG. 3 shows a front elevational view of an exemplary embodiment of a piston-operated pipette in accordance with the invention with the left part of the housing partially broken away.

FIG. 1 shows a piston-operated pipette 1 for transferring liquid with a drive unit 2, a displacement unit 3 and a coupling apparatus 4 which connects the two units. On the bottom end of the displacement unit 3, there are several shafts 5 for joining of pipette tips (not shown). The aspiration and ejection of the liquid take place via a piston 9' and a cylinder 9" which are located in the displacement unit 3 and which change the air volume in the pipette tips and beyond. FIG. 3 shows this, for example, in the section of the displacement unit 3, which section is open to the left.

FIG. 1 shows a multichannel piston-operated pipette 1 with several shafts 5, but the teaching can also be applied to a piston-operated pipette 1 with a single channel displacement unit 3. Likewise, the teaching can be used in positive displacement pipettes. Therefore, any form of the piston-operated pipette according to DIN EN ISO 8655-2 is suitable for use in accordance with the invention.

Figure 2:
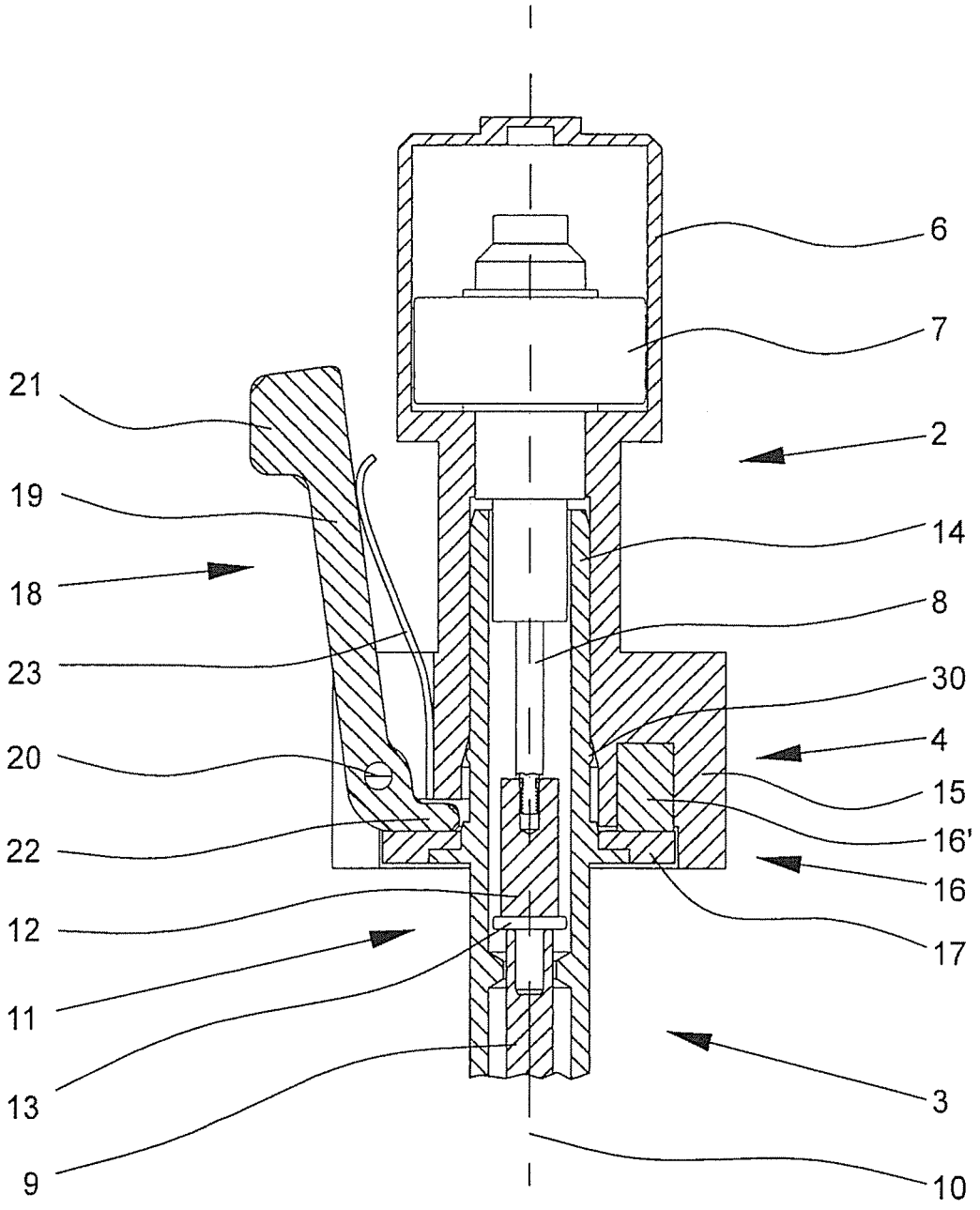
FIG. 2 shows, by way of extract, a vertical section of a drive unit and the upper region of a displacement unit of the piston-operated pipette from FIG. 1, the drive unit being mounted on the upper region of the displacement unit.

FIG. 2 shows the drive unit 2 and part of the displacement unit 3 together with the coupling apparatus 4 which acts between them. In the drive unit 2, which is surrounded by the housing 6, there is a stroke actuator 7 with an actuating drive 8 which drives a piston drive 9 in the displacement unit 3 in the direction of a common axis 10. The illustrated stroke actuator 7 is a positioning drive with an electric motor and battery. Other motive gearing, motive drives or power sources are possible. Normally, all necessary operating, display and control elements for operation and adjustment are located in the housing 6.

The piston drive 9 is, for its part, dynamically connected to the piston 9' which is not shown in FIG. 2, but is shown in FIG. 3. Between the actuating drive 8 and the piston drive 9, there is a first mechanical connection 11. This first mechanical connection 11 can be released. In the illustrated and preferred exemplary embodiments, it is made as magnetic connection 11. This first mechanical connection can, however, also be made as a purely mechanical connection, therefore frictionally engaged and/or form-fit (catch connection). It is important that this mechanical connection 11, when the displacement unit 3 is coupled to the drive unit 2, reliably couples the piston drive 9 to the actuating drive 8 so that the motion of the actuating drive 8 is transmitted reliably and precisely to the piston drive 9. However, it must also be possible to break the first mechanical connection 11 because, when the displacement unit 3 is separated from the drive unit 2, the piston drive 9 must be decoupled from the actuating drive 8.

The version of the first mechanical connection shown here as a magnetic connection 11 is formed of magnetic means, specifically a permanent magnet 12 on the actuating drive 8 and a soft-iron core 13 on the piston drive 9. The illustrated magnetic connection 11 can also be implemented by two permanent magnets or possibly also by a magnet which can be electrically disconnected. This connection 11, which transmits the drive motion is sufficiently dimensioned, but still can be released when a force is induced to an increased degree for normal motion. The separability can be enabled depending on the type of connection by detaching and/or removing the components or further necessary components.

The top end of the displacement unit 3 has a fastening section that is preferably comprised of a guide sleeve 14, the guide sleeve 14 being pushed coaxially relative to the axis 10 into a receiving section 15 of the drive unit 2. Within the guide sleeve 14 are the actuating drive 8, the piston drive 9 and the first mechanical connection 11, here in the form of the magnetic connection 11.

Figure 4:
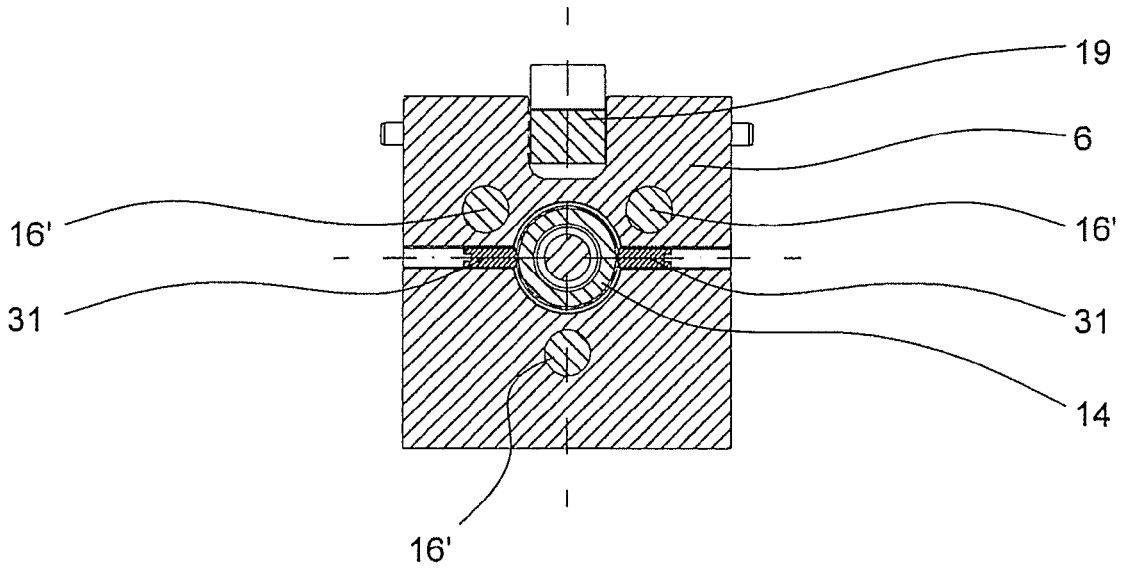
FIG. 4 shows the piston-operated pipette from FIG. 3 in a horizontal section taken along line IV-IV in FIG. 3.

There is a second mechanical connection 16 of the coupling apparatus 4 in the form of a magnetic connection 16 between the receiving section 15 of the drive unit 2 and the fastening section of the displacement unit 3, therefore the guide sleeve 14. In the illustrated embodiment, which is shown in FIGS. 2 and 4, the magnetic connection 16 is comprised of magnetic means, specifically several individual permanent magnets 16' which are fastened in the housing 6, and a disc 17 of soft-iron or other magnetic material which is attached to the guide sleeve 14. The magnetic connection 16 is dimensioned such that the thrust force which has been generated by the actuating drive 8 does not initiate unwanted separation during the expulsion of the liquid under any circumstance. The pipetted, dispensed volume must always be correct. The retaining force of the magnetic connection 16 is correspondingly high. In the preferred illustrated version and as is apparent in FIG. 4 for this reason there are three permanent magnets 16'.

FIG. 2 and the incremental representations from FIGS. 2*a* to 2*f*, at this point, show a mechanical means 18 which can be manually actuated and which is provided for breaking the magnetic connection 16 between the receiving section 15 and the fastening section. The magnetic connection 16 can be released by manual actuation of this means 18. In this way, the displacement unit 3 can be detached from the drive unit 2 with a comparatively small expenditure of force, and in any case, in a controlled manner. By breaking the magnetic connection 16, the latter is either completely neutralized or is weakened in its retaining force, in any case, to such an extent that the displacement unit 3 can then be removed from the drive unit 2 with a low expenditure of force and in a controlled manner.

As is especially apparent from FIGS. 2*d*, *e*, and *f*, which will be explained in greater detail below, in the illustrated exemplary embodiment, the magnetic connection 16 can be released by forcing the displacement unit 3 away from the drive unit 2. Here, the breaking motion is an axial movement along the common longitudinal axis 10.

As has already been noted above, the first detachable mechanical connection 11 between the actuating drive 8 and the piston drive 9 is made as a magnetic connection 11. The latter can likewise be released by actuating the means 18 which can be manually actuated for breaking the magnetic connection 16. In particular, this is explained below.

In the preferred exemplary embodiment which is shown in FIG. 2, it is provided that the means 18 can be manually actuated for separation for which it has a lever 19 which is supported with a fulcrum 20 on the drive unit 2 and acts on the displacement unit 3 when manually actuated to, in this way, break the magnetic connection 16.

Figure 8:
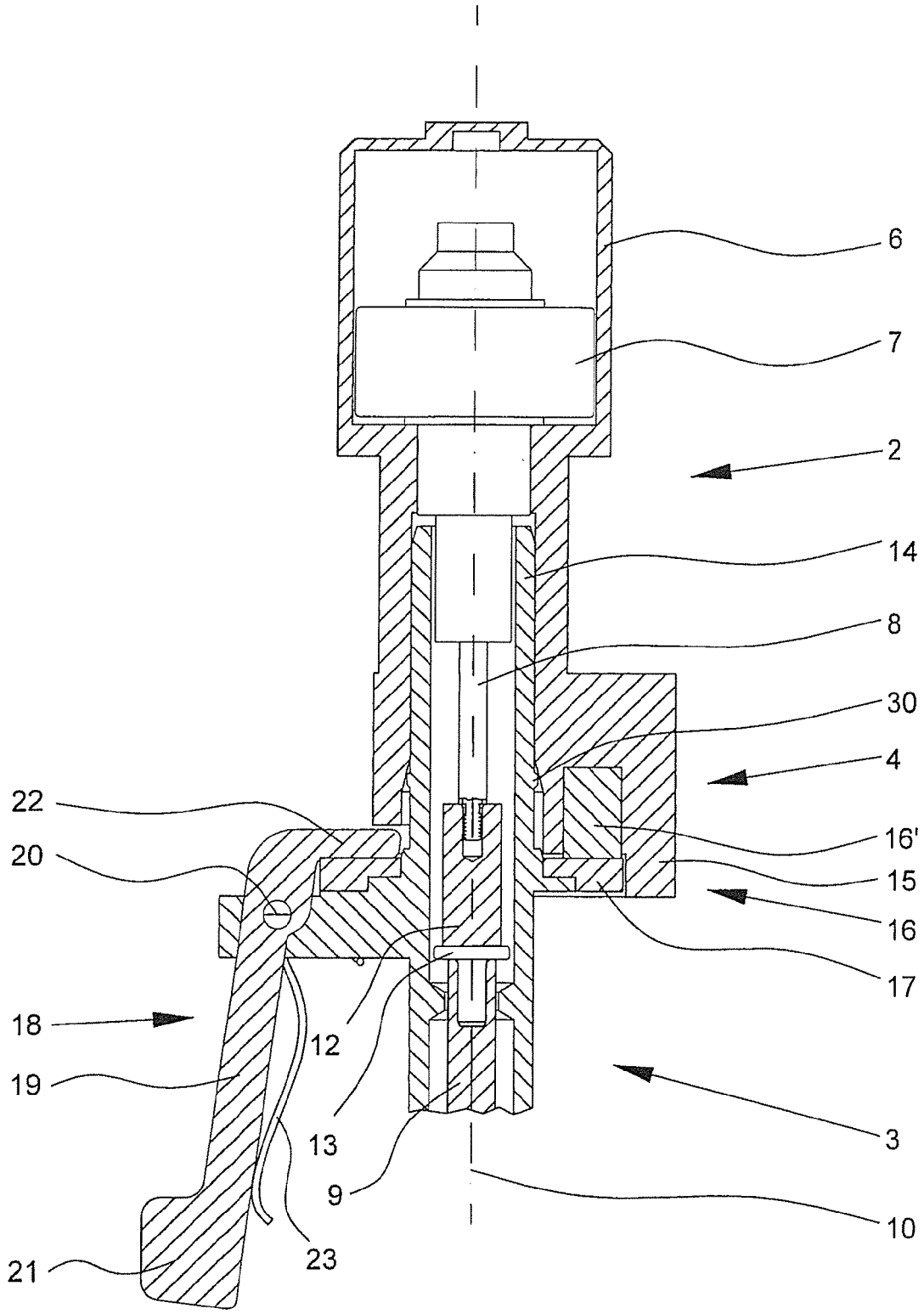
FIG. 8 is a sectional view corresponding to FIG. 2 but showing an exemplary embodiment of a piston-operated pipette in which the manually actuatable means for separation is mounted on the displacement unit instead of the drive unit.

FIG. 8 shows another construction in which the lever 19 is supported on the displacement unit 3 with a fulcrum 20 and acts on the drive unit 2 when manually actuated to, in this way, break the magnetic connection 16. In this construction, the drive unit 2 is separated from the displacement unit 3. However, as a result, this of course has the same effect; it is only a different design.

The preferred exemplary embodiment, which is shown in FIG. 2, is furthermore wherein the lever 19 has a pushbutton 21 which can be manually actuated and which, in the illustrated exemplary embodiment, can be actuated in a direction which is transverse to the direction of the motion of separation of the drive unit 2 and the displacement unit 3. In the exemplary embodiment which is shown in FIG. 2, it is provided here that the pushbutton 21 of the lever 19 which is supported here on the drive unit 2 is located above the fulcrum 20 of the lever 19. This positioning of the pushbutton 21 makes it possible to actuate the pushbutton 21 with the thumb, and at the same time, to hold the displacement unit 3 loosely with one or two fingers of the hand so that it cannot easily drop when detached from the drive unit 2.

FIG. 8 shows a reversed arrangement of the lever 19. There, the lever 19 with its pushbutton 21 extends down, not up. In this exemplary embodiment, the lever 19 is located on the displacement unit 3. This arrangement of the lever 19 with the pushbutton 21 which extend down, however, can also be feasible with respect to handling for a lever 19 which is located on the drive unit 2.

The exemplary embodiment which is shown in FIG. 2 is also wherein the lever 19 has a lever arm 22 for breaking the magnetic connection 16. Moreover, there is a reset spring 23 which is supported on the housing 6 of the drive unit 2 and which presses the longer lever arm with the pushbutton 21, and thus, presses the lever 19 altogether into its rest position in which the magnetic connection 11 is not released. This is used as a defined position of the lever 19 on the piston-operated pipette 1.

The exemplary embodiment which is shown in FIG. 2 also shows that, here, the distance of the pushbutton 21 from the fulcrum 20 of the lever 19 is much longer than the lever arm 22. In the illustrated and preferred embodiment, this distance is roughly six times as long as the lever arm 22 of the lever 19. In this way, there is a corresponding path reduction and force increase. The pushbutton 21 is moved over a relatively large path, but this takes place with very small force. The small separating lever arm 22 is moved over a comparatively short travel path, but with a high force which is matched to the retaining force of the magnetic connection 16.

Preferably, it is provided that the travel path of the lever arm 22 for manual actuation for purposes of separation is roughly 0.3 mm to 2.0 mm, preferably roughly 1.0 mm. This applies to the exemplary embodiment which is shown here and which is preferred in this respect.

FIGS. 2*a* to 2*f* show a preferred piston-operated pipette 1 in the positions of movement of different sequences.

Figure 2A:
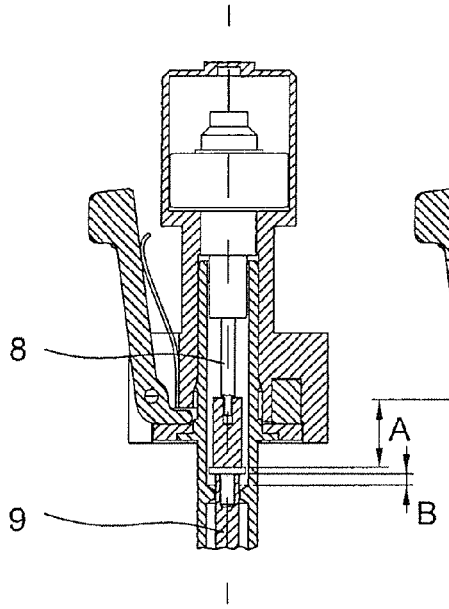
FIGS. 2*a* to 2*f* show representations as in FIG. 2 in different positions of the different parts of the piston-operated pipette which correspond to different operating states, specifically.

FIG. 2*a* is the typical rest, starting and dispensing position of the pipette. Here, the actuating drive 8 and the piston drive 9 as well its piston are in the lower quarter of the travel region. The actuating drive 8 is extended to roughly three-fourths of its maximum travel path.

Figure 2B:
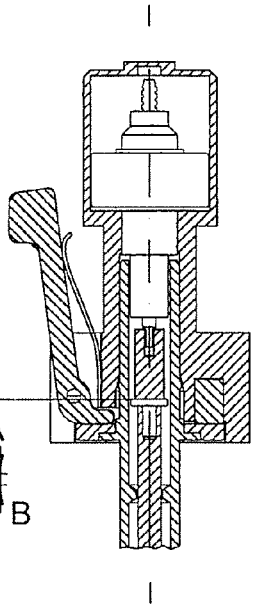

The pipette tip (not shown) is immersed into the liquid. For subsequent aspiration, the actuating drive 8 is advanced, therefore, the piston drive 9 with the piston in the cylinder is displaced upward in the figure. The travel A for a manual piston-operated pipette 1 is limited by stops (not shown) or for an electric-motorized piston-operated pipette 1, for example, defined by the preselected revolutions of the drive. The maximum travel A is shown in FIG. 2*b*.

Figure 2C:
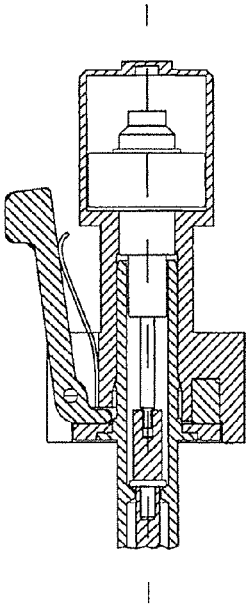

To dispense the liquid from the pipette tip into another vessel, the piston is moved into the start position of FIG. 2*a*; this can likewise be limited. To dispense the remainder of a liquid, the piston can be moved a short distance further, as is shown in FIG. 2*c* (overtravel B).

If the displacement unit 3 is to be replaced or another one, for example, one with a larger piston or one with a different number of channels, is to be used, this is possible due to the coupling apparatus 4.

Figure 2D:
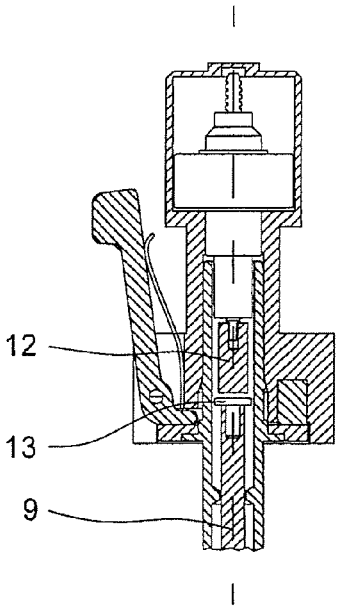

In the illustrated embodiment, the actuating drive 8 and the piston drive 9 are connected by a first magnetic connection 11 and are separated as shown in FIG. 2*d*. The actuating drive 8 is moved for this purpose beyond the maximum travel motion A of the piston drive 9, and in this way, the permanent magnet 12 is detached from the soft-iron core 13. This is apparent in the transition from FIG. 2*c* to FIG. 2*d*.

The upward motion of the piston drive 9 is arrested by a stop. The actuating drive 8 is moved a little farther up by means of the stroke actuator 7. In this way, the permanent magnet 12 is separated from the soft-iron core 13. The first mechanical connection in the form of the magnetic connection 11 is separated. It can be recognized in this description that, in this case, the mechanical means 18 for separation for the first mechanical connection 11 has no function.

Figure 2E:
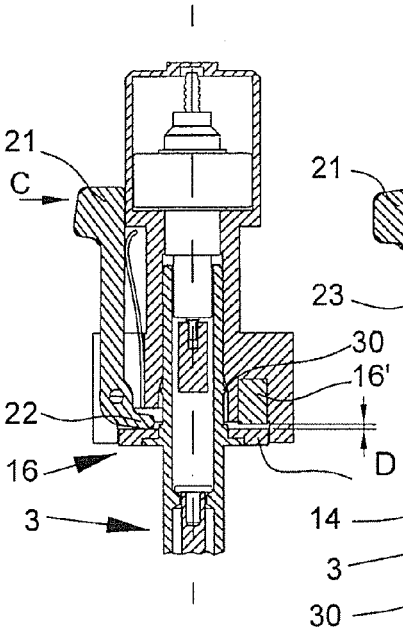

The stronger magnetic connection 16 between the permanent magnet 16' and the disk 17 of soft-iron or magnetic material is released by the mechanical means 18 which can be manually actuated and which is further provided. FIG. 2*e* shows how the lever 19 on its pushbutton 21 is pressed against the spring force of the reset spring 23 in the direction of the arrow C. The arm with the pushbutton 21 is clearly longer than the shorter lever arm 22. With the lever arm 22 the high retaining force of the magnetic connection 16 can be easily overcome manually. The short travel path of the short lever arm 22 causes a small acceleration of the separated displacement unit 3.

The travel path D in FIG. 2*e* is so short that, when the button 21 is pressed, the magnetic force between the magnetic means of the magnetic connection 16 is greater than the force due to the weight of the displacement unit 3. In handling, this version causes only a small acceleration of the falling displacement unit 3 when the pushbutton 21 is actuated or only a short movement of the displacement unit 3 down analogously to the path of the short lever arm 22. In the illustrated version, the travel path D of the short lever arm 22 is roughly 1 mm. The action which is advantageous in handling is achieved here by a travel path D of the short lever arm 22 being limited to 0.3 to 2 mm.

Fundamentally, it is also possible to effect the withdrawal of the displacement unit 3 with an actuator, for example, by the displacement unit 3 being held in a rest position and the drive unit 2 being raised. In an alternative version, the switching of the catches into the locking and release position can be implemented by means of an actuator. Likewise, the switching process can be initiated in manual or actuator deposition of the displacement unit 3 in a rest.

Figure 2F:
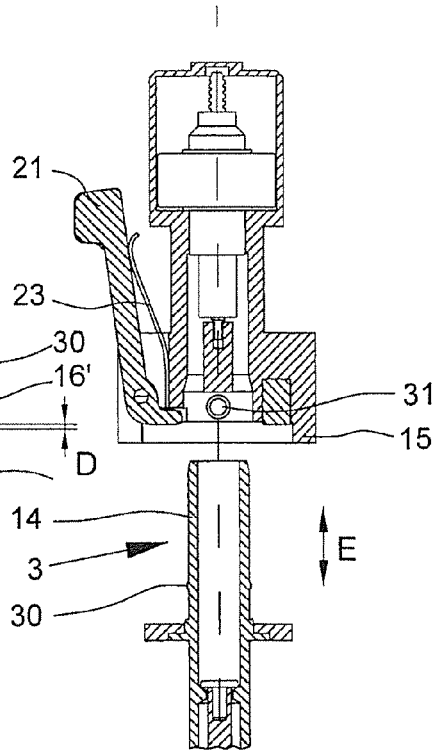

FIG. 2*f* shows the displacement unit 3 which has been withdrawn from the drive unit 2 and its joining movements are indicated with the vertical arrow E. When rejoining the displacement unit 3, the guide sleeve 14 is pushed forward into the receiving section 15 of the drive unit 2 until the magnetic connection 16 couples again. In doing so, optionally, the first magnetic connection 11 comes together again or it is engaged by extending the actuating drive 8.

FIG. 2*f* shows the unactuated lever 19 in its rest position which has been assumed again by the reset spring 23. In this rest position, the short lever arm 22 lies behind the planes which define the bottom of the permanent magnet 16' (FIG. 2). The displacement unit 3, which has been joined again, can produce the magnetic connection 16 of with its disc 17 with the permanent magnet 16' uninfluenced by the lever 19.

By definition, when the displacement unit 3 is re-joined, the lever 19 should be actuated as shown in FIG. 2*e*. The guide sleeve 14 is pushed in until the disc 17 adjoins the short lever arm 22 and the magnetic force begins to take effect. Then, the other magnetic connection 16 is gently and manually coupled in a controlled manner by slowly releasing the lever 19 on the button 21.

Consequently, the stroke actuator 7 is started and the actuating drive 8 with the permanent magnet 12 travels down into the position which is shown in FIG. 2*c*. In this way, at least the magnetic connection 11 between the permanent magnet 12 and the soft-iron core 13 occurs again. With the subsequent travel motion upward into the position of the actuating drive 8 and of the piston drive 9 shown in FIG. 2*a*, the piston-operated pipette 1 is again ready to aspirate further liquid.

Alternatively to the version preferred in this respect, the magnetic connection 11 can be manually released in the direction of the arrow E downward after breaking the magnetic connection 16.

The magnetic connection 11 can also be released at the same time with the magnetic connection 16 with the mechanical means 18 which is provided in accordance with the invention.

The ratio of the arm lengths of the lever 19 allows manually easy, ergonomic actuation. The separation process takes place here in a controlled manner with one hand, the thumb actuating the button 21 and other fingers keeping the displacement unit 3 on the disc 17 from falling down.

The two alternative versions protect the drive of the stroke actuator 7 which breaks the magnet connection 11 relative to the travel movement of the piston drive 9 with increased drive performance (FIG. 2*d*).

Figure 5A:
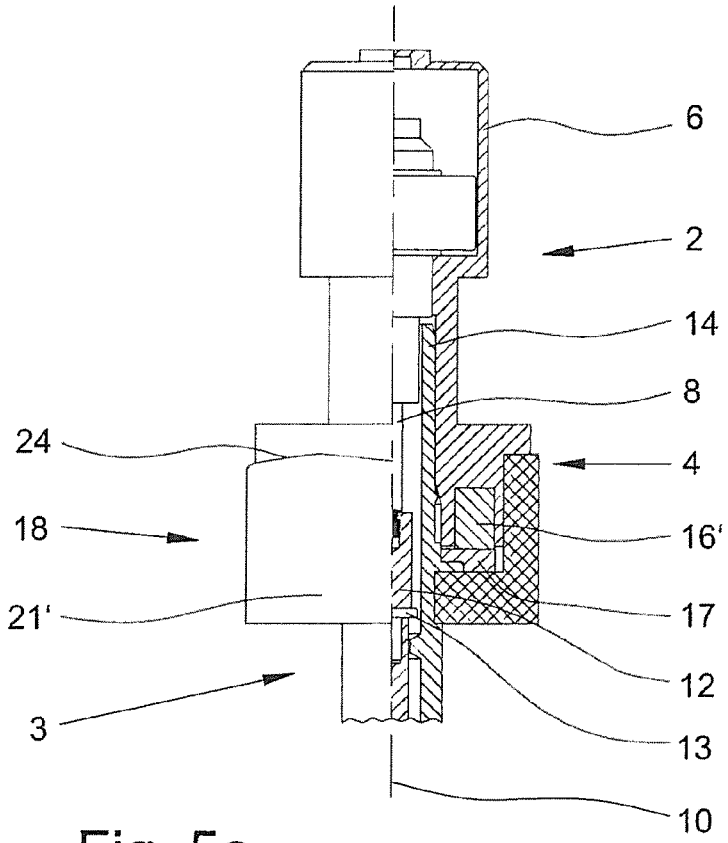
FIG. 5*a* shows another embodiment of a piston-operated pipette in accordance with the invention, the right half being sectioned to show the displacement unit and drive unit coupled.
Figure 5B:
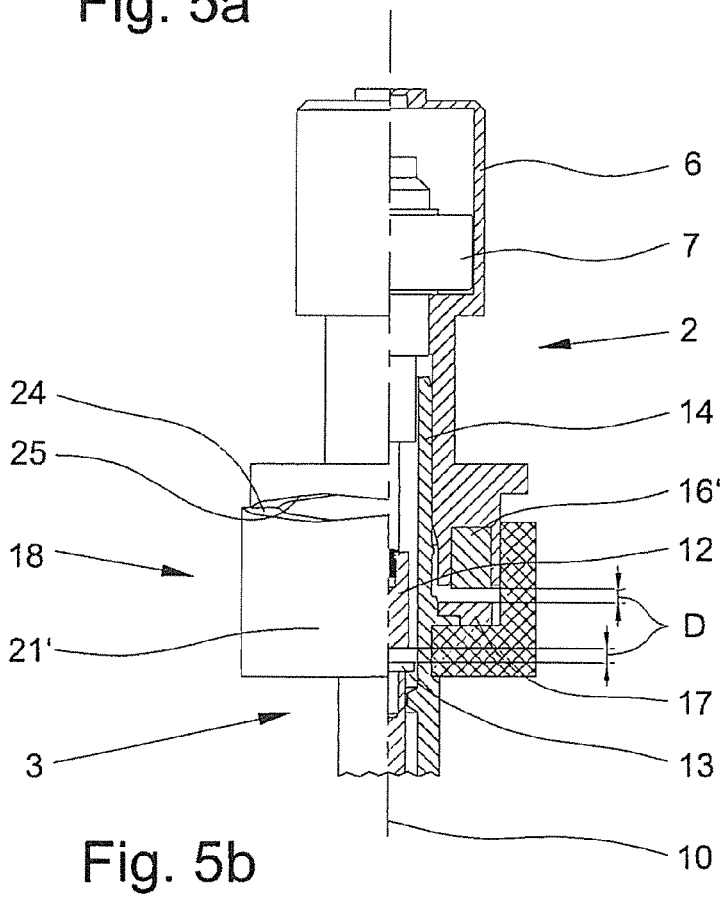
FIG. 5*b* shows the piston-operated pipette from FIG. 5*a* with the magnetic connection released.

FIGS. 5*a* and 5*b* show a first alternative in the construction of the coupling apparatus 4. In this alternative, the mechanical means 18 which can be mechanically actuated for breaking the magnetic connection 16 on the displacement unit 3 has an axially profiled cam disc 24 on a rotary wheel 21' and a cam guide 25 on the drive unit 2 which is congruent to the cam disc 24. The magnetic connection 16 can be separated from the permanent magnet 16' and the disc 17 can be separated from the soft-iron by a rotary motion of the rotary wheel 21' with the cam disc 24 and the cam guide 25 relative to one another. In the illustrated and preferred exemplary embodiment, the rotary wheel 21' is rotatably mounted with the cam disc 24 on the displacement unit 3. The cam disc 24 is turned around the longitudinal axis 10 for separation.

In the illustrated exemplary embodiment, the cam disk 24 has several, preferably three, axially projecting cams. The cam guide 25 which is provided on the drive unit 2 is profiled congruently thereto. In a comparison of FIG. 5*a* and FIG. 5*b*, it can be recognized that by turning the displacement unit 3 opposite the drive unit 2, the cam disc 24 is turned opposite the cam guide 25, and in this way, the separation process takes place.

If the drive unit 2 is connected torsionally stiffly to the displacement unit 3 with the magnetic connection 16 closed, it can also be provided that the cam disc 24 is itself pivotally mounted on the displacement unit 3. Then, the displacement unit 3 remains stationary opposite the drive unit 2 during separation and only the cam disc 24 is turned opposite the displacement unit 3 and opposite the cam guide 25 on the drive unit 2.

The arrangement of the cam disc 24 and the cam guide 25 can also be chosen to be the reverse with respect to the drive unit 2 and the displacement unit 3.

By turning the cam disc 24 opposite the cam guide 25, the displacement unit 3 is moved axially by the drive unit 2 with a travel path similar to the exemplary embodiment with the lever arm 22 and the magnetic connection 16 is released (if necessary also the magnetic connection 11 jointly with it).

Figure 6A:
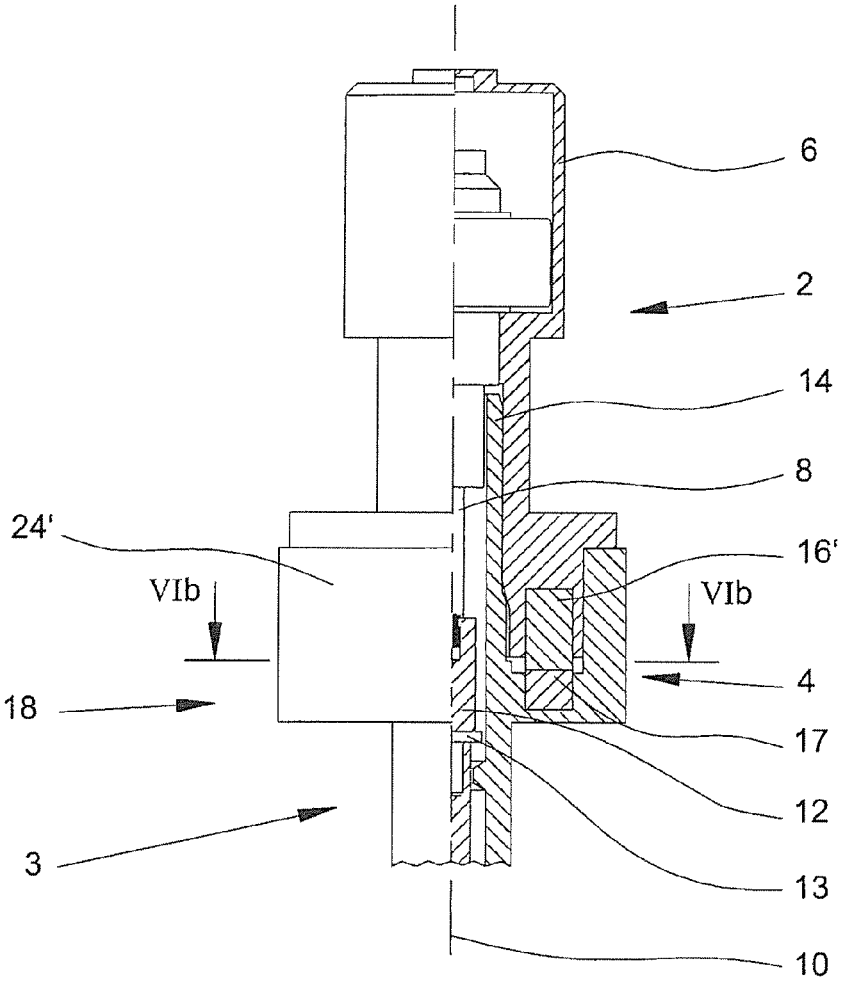
FIG. 6*a* shows another exemplary embodiment of a piston-operated pipette in accordance with the invention, the right half being sectioned to show the displacement unit and drive unit coupled.
Figure 6B:
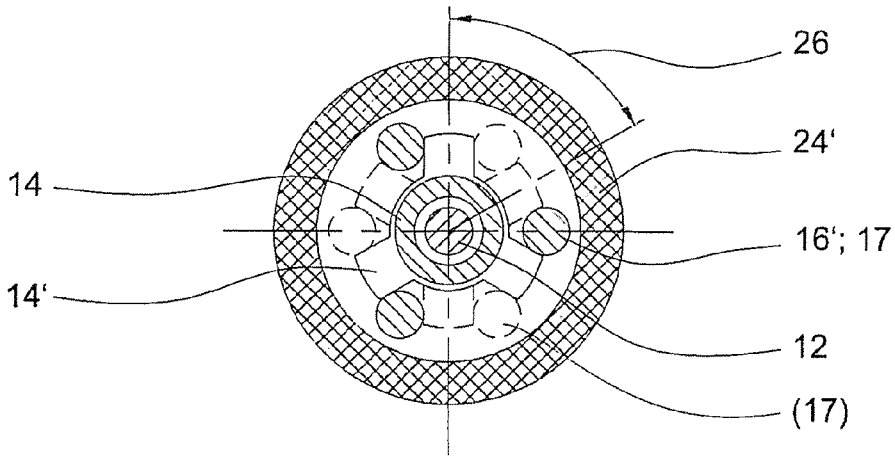
FIG. 6*b* is a horizontal sectional view showing the piston-operated pipette taken along line VIb in FIG. 6*a*.

Another version for the mechanical means 18 which can be manually actuated for separation is shown in FIGS. 6*a*, 6*b*. In this case, the magnetic means of the magnetic connection 16 as such, or the displacement unit 3 and the drive unit 2, can be turned relative to one another around the longitudinal axis 10 with the magnetic connection 16 closed.

In the illustrated exemplary embodiment, the drive unit 2 and the displacement unit 3 can be turned altogether relative to one another around the longitudinal axis 10, as the double arrow 26 in FIG. 6*b* illustrates. In the first position, which is shown in FIG. 6*a*, the magnetic means 16', 17 of the magnetic connection 16 are congruently opposite and are thus completely active. In the position which is shown in FIG. 6*b* in a section, only the magnetic means 16' are visible cut-away, the means 17 are concealed underneath. Moreover, in an additionally illustrated second rotary position it is apparent that the magnetic means 16', 17 are no longer congruently opposite. The magnetic means 17 (shown by the broken line) is offset to the means 16'. They are therefore less active or inactive. This is the position in which the magnetic connection 16 can be released with a small expenditure of force. The second rotary position is shown by the broken line in FIG. 6*b*.

It is structurally provided in FIG. 6*b* that the guide sleeve 14 in addition to an outer ring 24' has at least one stop 14'. In the example which is shown in FIG. 6*b*, three stops 14' are molded radially on the guide sleeve 14. They are dynamically connected to the magnetic means 16' of the drive unit 2. In the first rotary position which is shown in FIG. 6*b* in solid lines, the stops 14' are struck counterclockwise. From there, rotary motion in the opposite direction, therefore clockwise, can move the stops 14' into the position shown by the broken line.

In the second rotary position, the magnetic means 17 on the turned displacement unit 3 are no longer congruent with the magnetic means 16' of the drive unit 2, and are magnetically inactive. Alternatively, the magnetic means 16', 17 overlap only slightly, their retaining force being so small that the drive unit 2 and the displacement unit 3 can be easily manually separated without a large expenditure of force. Preferably, the magnetic forces in the second rotary position are sufficient to be still higher than the force due to the weight of the displacement unit 3 so that the displacement unit 3 does not simply fall away from the drive unit 2.

It is apparent in FIG. 6*a* that the magnetic means 16', 17 have the same distance relative to the longitudinal axis 10. Furthermore, it is apparent in FIG. 6*b* that the magnetic means 16' on the receiving section 15 of the drive unit 2 have an identical distance also relative to one another, specifically they are each located at an angle of 120° around the longitudinal axis 10.

Figure 7A:
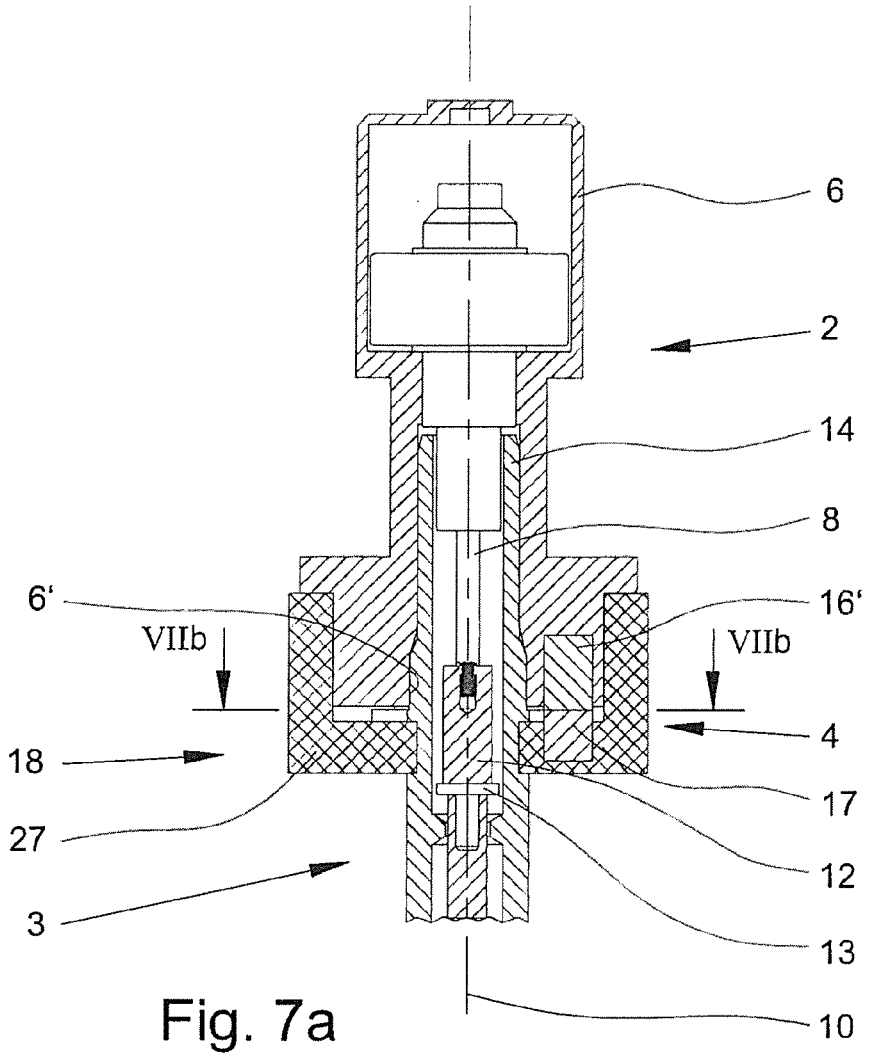
FIG. 7*a* is a sectional view of another exemplary embodiment of a piston-operated pipette in accordance with the invention.
Figure 7B:
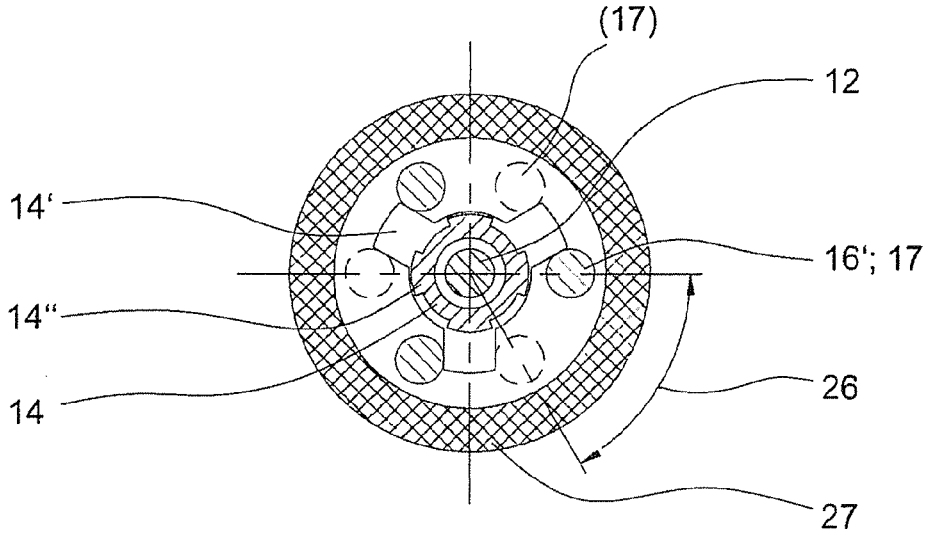
FIG. 7*b* is a horizontal sectional view of the piston-operated pipette from FIG. 7*a* taken along line VIIb in FIG. 7*a*.

In a further preferred embodiment according to FIGS. 7*a* and 7*b*, it is shown that, for breaking only the further magnetic connection 16, there is a holder 27 for the magnetic means 17 on the displacement unit 3, which holder can be turned relative to the magnetic means 16' on the drive unit 2 and relative to the displacement unit 3. It is shown in FIG. 7*a* how the holder 27 is rotatably mounted on the guide sleeve 14 for this purpose, but is connected axially stationary to it. Depending on the rotational position of the holder 27, the magnetic means 16', 17 of the drive unit 2 and the displacement unit 3 are arranged congruently and are active or are moved out of congruency and are inactive, as described above. When the holder 27 is actuated on the displacement unit 3, it can be detached with one hand and can be removed from the drive unit 2.

In this version, the drive unit 2 and the displacement unit 3 are connected in a torsionally rigid manner, for which congruent profilings 6', which extend in a lengthwise direction, are located on the receiving section 15 of the housing 6 and 14" on the guide sleeve 14. They enable a connection of the drive unit 2 and the displacement unit 3 in at least one predetermined position. In FIG. 7*b*, four positions which are offset relative to each other by 90° are possible, but a larger number of positions is still more practical.

The rotary motion 26 of the holder 27 with the magnetic means 17 are limited by the indicated stop surfaces on the stops 14'. The rotary motion 26 clockwise shifts the position of the magnetic means 17 away from the means 16' in the drive unit 2 so that the magnetic connection 16 becomes inactive.

Other catches and springs which control the rotary motion 26 and which support the rotary positions are not shown. Nor is the combination of embodiments shown, for example, of FIG. 5 with FIG. 7, with a rotary cam ring which also has magnetic means 17 or profiling 6' and 14", and thus, advantageously allows the magnetic connection 16 to become inactive in handling and breaks the magnetic connection 11.

In the embodiment as shown in FIGS. 2 & 4, there is a retaining device for the displacement unit 3. For this purpose, a collar 30 which protrudes in the radial direction is molded on the outer surface of the guide sleeve 14. One or more catches 31 which are located in the housing 6 act on this collar. The catch 31 protrudes so far in the direction of the axis 10 that, in the illustrated arrangement, in its range of motion it comes to rest underneath the collar 30 in the direction of the axis 10. FIG. 4, the horizontal section at the height of the catch 31, shows two opposite catches 31.

The retaining device 30, 31 leads to the displacement unit 3 still hanging loosely on the drive unit 2 even after breaking the magnetic connection 16 (and the magnetic connection 11), only mechanically still held by the catches 31 on the collar 30. They can easily give way when force is applied so that the displacement unit 3 can finally be separated from the drive unit 2 with little expenditure of force. This yields an additional mechanical safeguard which makes it possible to prevent the displacement unit 3 from falling unintentionally off the drive unit 2.

In the illustrated exemplary embodiment, the retaining device 30, 31 can be detached by pulling down on the displacement unit 3. Alternatively, there can be a special construction for the retaining device 30, 31, for example, by means of a button which can be manually actuated or by means of some other kind of actuator.

What is claimed is:

1. A piston-operated pipette, comprising: a drive unit and a displacement unit which is mounted on the drive unit and which has a piston drive for at least one piston, wherein the displacement unit is dismountable from the drive unit, wherein the drive unit has an actuating drive for the piston drive and a receiving section for the displacement unit, wherein the displacement unit has a fastening section which fits the receiving section of the drive unit, wherein there is a first detachable mechanical connection between the actuating drive and the piston drive, wherein there is a second detachable mechanical connection between the receiving section of the drive unit and the fastening section of the displacement unit, wherein at least the second detachable mechanical connection comprises a magnetic connection, and wherein a mechanical means for separating the magnetic connection between the receiving section and the fastening section is provided.

2. The piston-operated pipette in accordance with claim 1, wherein the mechanical means for breaking the magnetic connection is manually actuatable.

3. The piston-operated pipette in accordance with claim 1, wherein the magnetic connection is releasable by a separating motion that forces the displacement unit and the drive unit apart.

4. The piston-operated pipette in accordance with claim 1, wherein the separating motion of the drive unit and displacement unit is an axial movement along a common longitudinal axis.

5. The piston-operated pipette in accordance with claim 1, wherein the first detachable mechanical connection comprises a magnetic connection.

6. The piston-operated pipette in accordance with claim 5, wherein the magnetic connection between the actuating drive and the piston drive is releasable by manually actuating the means for separating the magnetic connection.

7. The piston-operated pipette in accordance with claim 2, wherein the mechanical means for separating the magnetic connection comprises a lever which is supported by a fulcrum on the drive unit, and when actuated manually, acts on the displacement unit in a manner that separate the magnetic connection.

8. The piston-operated pipette in accordance with claim 7, wherein the lever has a pushbutton which is manually actuatable.

9. The piston-operated pipette in accordance with claim 8, wherein the pushbutton of the lever actuatable in a direction which is transverse to a direction of a separating motion of the drive unit and displacement unit.

10. The piston-operated pipette in accordance with claim 8, wherein the pushbutton of the lever is located above the fulcrum of the lever.

11. The piston-operated pipette in accordance with claim 8, wherein the lever has a lever arm configured to separate the magnetic connection and wherein a distance of the pushbutton from the fulcrum of the lever is longer than the lever arm.

12. The piston-operated pipette in accordance with claim 11, wherein the lever arm has a travel path for manual actuation for purposes of separation of 0.3 mm to 2.0 mm.

13. The piston-operated pipette in accordance with claim 11, wherein the lever arm has a travel path for manual actuation for purposes of separation of 1.0 mm.

14. The piston-operated pipette in accordance with claim 2, wherein the mechanical means for separation comprises a lever which is supported by a fulcrum on the drive unit and acts on the displacement unit when manually actuated to separate the magnetic connection, wherein the lever has a pushbutton which is manually actuatable, wherein a separating motion of the drive unit and displacement unit is an axial movement along a common longitudinal axis, wherein the pushbutton of the lever is actuatable in a direction which is transverse to a direction of the separating motion of the drive unit and displacement unit, wherein the lever has a lever arm for separating the magnetic connection, and wherein a distance of the pushbutton from the fulcrum of the lever is longer than the lever arm.

15. The piston-operated pipette in accordance with claim 2, wherein the mechanical means for separating the magnetic connection comprises an axially profiled cam disc and a cam guide which is congruent to the cam disc and wherein the magnetic connection is releasable by a rotary motion of the cam disc and the cam guide relative to one another.

16. The piston-operated pipette in accordance with claim 15, wherein the cam disc is located on the displacement unit and the cam guide is located on the drive unit.

17. The piston-operated pipette in accordance with claim 16, wherein the cam disc is rotatably mounted on the displacement unit and separation is producible by rotation of only the cam disc.

18. The piston-operated pipette in accordance with claim 2, wherein the receiving section of the drive unit and the fastening section of the displacement unit each have at least one magnetic means of the magnetic connection, wherein at least the magnetic means of the magnetic connection are rotatable relative to one another with the magnetic connection closed and wherein the magnetic means are oppositely congruently active in a first rotary position and in a second rotary position are out of congruency and at least substantially inactive.

19. The piston-operated pipette in accordance with claim 18, wherein the means for separating the magnetic connection is a holder for the magnetic means on one of the displacement unit and the drive unit, which the holder turnable together with the magnetic means relative to the magnetic means on the other of the drive unit and the displacement unit.

20. The piston-operated pipette in accordance with claim 1, further comprising a mechanical retaining device which detachably limits separating motion of the drive unit and displacement unit, and wherein the displacement unit is removable from the drive unit with minimal actuating force after separating the magnetic connection.

21. The piston-operated pipette in accordance with claim 2, further comprising a mechanical retaining device which detachably limits separating motion between the drive unit and displacement unit, and wherein, after separating the magnetic connection, the displacement unit is manually removable from the drive unit.

22. The piston-operated pipette in accordance with claim 21, wherein the mechanical means for separating has a lever which is supported with a fulcrum on the drive unit and when actuated manually acts on the displacement unit so as to separate the magnetic connection, wherein the lever has a pushbutton which is manually actuatable, wherein a separating motion of the drive unit and displacement unit is an axial movement along a common longitudinal axis, wherein the pushbutton of the lever is actuatable in a direction which is transverse to a direction of the separating motion of the drive unit and displacement unit, wherein the lever has a lever arm for separating the magnetic connection, wherein the pushbutton is a distance from the fulcrum of the lever that is longer than the lever arm.

23. The piston-operated pipette in accordance with claim 1, wherein the drive unit and the displacement unit are connected in a torsionally rigid manner by congruent profiling on the receiving section and on the fastening section.

* * * * *